US007416364B2

(12) United States Patent
Yodock, III et al.

(10) Patent No.: US 7,416,364 B2
(45) Date of Patent: Aug. 26, 2008

(54) PIVOT UNIT FOR BARRIER DEVICES

(76) Inventors: Leo J. Yodock, III, 1775 Fifth Street Hollow, Bloomsburg, PA (US) 17815; Leo J. Yodock, Jr., 44 Duke of Gloucester St., Bloomsburg, PA (US) 17815; Guy C. Yodock, 3421 SW. 18th St., Fort Lauderdale, FL (US) 33312

( * ) Notice: Subject to any disclaimer, the term of this patent is extended or adjusted under 35 U.S.C. 154(b) by 100 days.

(21) Appl. No.: 11/560,913

(22) Filed: Nov. 17, 2006

(65) Prior Publication Data

US 2007/0206990 A1 Sep. 6, 2007

Related U.S. Application Data

(60) Provisional application No. 60/778,762, filed on Mar. 3, 2006.

(51) Int. Cl.
*E01F 13/00* (2006.01)
*E01F 15/00* (2006.01)

(52) U.S. Cl. ..... 404/6; 404/9; 256/13.1

(58) Field of Classification Search ..... 404/6, 404/9; 256/13.1

See application file for complete search history.

(56) References Cited

U.S. PATENT DOCUMENTS 3,326,099 A 6/1967 Cova et al.
3,606,258 A 9/1971 Fitch
3,698,290 A 10/1972 Wallace
3,704,861 A 12/1972 Glaesener
3,784,167 A 1/1974 Glaesener
3,856,268 A 12/1974 Fitch
3,876,185 A 4/1975 Welch
3,880,404 A 4/1975 Fitch
3,967,704 A 7/1976 Ogden
4,007,917 A 2/1977 Brubaker
4,059,362 A 11/1977 Smith
4,307,973 A 12/1981 Glaesener
4,321,989 A 3/1982 Meinzer
4,391,077 A 7/1983 Giess
4,415,680 A 11/1983 Ushirokawa et al.
4,681,302 A * 7/1987 Thompson ..... 256/13.1
4,773,629 A 9/1988 Yodock et al.
4,775,854 A 10/1988 Cottrell
4,780,020 A 10/1988 Terio
4,806,044 A 2/1989 Duckett
4,815,889 A 3/1989 Duckett (Continued)

FOREIGN PATENT DOCUMENTS

FR 631 582 A1 11/1989

(Continued)

*Primary Examiner*—Raymond W Addie
(74) *Attorney, Agent, or Firm*—GrayRobinson, PA

(57) ABSTRACT

A pivot unit for use with barrier devices which may be connected end-to-end to form a barrier wall. The pivot unit comprises first and second end connectors, each of which may be coupled to the end of one barrier device, and a hinge post extending between the end connectors. The hinge post is mounted by a pin to each end connector allowing pivotal motion of one end connector, and the barrier device to which it is coupled, through an angle of at least 90° relative to the other end connector and its associated barrier device.

16 Claims, 2 Drawing Sheets

U.S. PATENT DOCUMENTS

| | | | | |
|---|---|---|---|---|
| 4,869,619 | A | 9/1989 | Akesaka | |
| 4,917,219 | A | 4/1990 | Henry | |
| 4,946,306 | A | 8/1990 | Yodock et al. | |
| 4,982,535 | A | 1/1991 | Pickett | |
| 5,002,423 | A | 3/1991 | Mileti | |
| 5,009,542 | A | 4/1991 | Hardin, Jr. et al. | |
| 5,011,325 | A | 4/1991 | Antonioli | |
| 5,046,884 | A | 9/1991 | Girotti | |
| 5,052,850 | A | 10/1991 | Bishop | |
| 5,104,254 | A | 4/1992 | Durand | |
| 5,123,773 | A | 6/1992 | Yodock et al. | |
| 5,136,810 | A | 8/1992 | DeWitt, III | |
| 5,429,448 | A | 7/1995 | Ballesteros | |
| 5,498,101 | A | 3/1996 | Braverman | |
| 5,531,540 | A | 7/1996 | Wasserstrom et al. | |
| 5,551,796 | A | 9/1996 | Anderson, Jr. et al. | |
| 5,605,413 | A | 2/1997 | Brown | |
| 5,607,252 | A | 3/1997 | Tischer | |
| 5,688,071 | A | 11/1997 | Owen | |
| 5,882,140 | A | 3/1999 | Yodock et al. | |
| 5,988,934 | A | 11/1999 | Wasserstrom | |
| 6,059,491 | A | 5/2000 | Striefel et al. | |
| 6,082,926 | A | 7/2000 | Zimmer | |
| 6,152,064 | A | 11/2000 | Morton | |
| 6,179,516 | B1 | 1/2001 | Ivey et al. | |
| 6,221,928 | B1 | 4/2001 | Kozma et al. | |
| 6,257,559 | B1 * | 7/2001 | Mouri | 256/26 |
| 6,474,904 | B1 * | 11/2002 | Duckett et al. | 404/6 |
| 6,477,807 | B1 | 11/2002 | Crondhal et al. | |
| 6,485,224 | B1 * | 11/2002 | Dyke et al. | 404/6 |
| 6,666,616 | B2 | 12/2003 | Yodock, III et al. | |
| 2002/0025221 | A1 | 2/2002 | Johnson | |
| 2003/0219308 | A1 * | 11/2003 | Boulais et al. | 404/6 |
| 2004/0146347 | A1 * | 7/2004 | Davis et al. | 404/6 |
| 2005/0254892 | A1 | 11/2005 | Yodock et al. | |
| 2007/0110517 | A1 * | 5/2007 | Wasserstrom et al. | 404/6 |

FOREIGN PATENT DOCUMENTS

| | | | |
|---|---|---|---|
| GB | 121 424 | A | 12/1918 |
| GB | 2 292 404 | A | 2/1996 |
| WO | 02/055790 | A1 | 7/2002 |

* cited by examiner

PIVOT UNIT FOR BARRIER DEVICES

FIELD OF THE INVENTION

This invention relates to barrier devices for vehicular traffic control, soil erosion containment, impact attenuation and the like which can be interconnected with one another to define a barrier wall structure, and, more particularly, to a pivot unit for barrier devices which allow them to articulate relative to one another through an angle of at least 90°.

BACKGROUND OF THE INVENTION

A variety of different devices have been developed for absorbing the kinetic energy resulting from impact with a moving vehicle, and for the containment of forces exerted by soil or water. Highway barriers, for example, are intended to provide a continuous wall or barrier along the center line or shoulder of a highway when laid end-to-end to absorb grazing blows from moving vehicles. One commonly used highway barrier is formed of pre-cast reinforced concrete, and is known as the "Jersey" style barrier. Highway barriers of this type have a relatively wide base resting on the pavement or shoulder of the highway, opposed side walls and opposed end walls. The side walls consist of a "curb reveal" extending vertically upwardly from the base a short distance, a vertically extending top portion connected to the top wall of the barrier and an angled portion between the curb reveal and the vertical top portion. This design is intended to contact and redirect the wheels of a vehicle in a direction toward the lane of traffic in which the vehicle was originally traveling, instead of the lane of opposing traffic. See, for example, U.S. Pat. No. 4,059,362.

One problem with the Jersey-style highway barriers described above is the weight of reinforced concrete. A concrete barrier having a typical length of twelve feet weighs about 2,800-3,200 pounds, and requires special equipment to load, unload and handle on site. It has been estimated that for some road repairs, up to 40 percent of the total cost is expended on acquiring, delivering and handling concrete barriers. Additionally, concrete barriers have little or no ability to absorb shock upon impact, and have a high friction factor. This increases the damage to vehicles which collide with such barriers, and can lead to serious injuries to passengers of the vehicle.

In an effort to reduce weight, facilitate handling and shipment, and provide improved absorption of vehicle impact forces, highway barriers have been designed which are formed of a hollow plastic container filled with water, sand or other ballast material such as disclosed in U.S. Pat. Nos. 4,681,302, 4,773,629, 4,946,306, 5,123,773 and 5,882,140. For example, the '302 patent discloses a barrier comprising a housing having a top wall, bottom wall, opposed side walls and opposed end walls interconnected to form a hollow interior which is filled with water. The ends of each barrier couple to an adjacent barrier to form a continuous wall. The container structure is preferably formed of a resilient, plastic material which is deformable upon impact and capable of resuming its original shape after being struck.

The '629, '306, '773 and '140 patents noted above represent advances in deformable highway barrier designs. The first two patents disclose barriers which comprise a longitudinally extending housing made of semi-rigid plastic which is self-supporting, and has a predetermined shape which is maintained when filled with water, sand or other ballast material. Such devices are connected end-to-end by a key insertable within grooves formed in the end walls of adjacent barriers. Interconnected fill openings are provided which permit adjacent barriers to be filled with water or other ballast material when laid end-to-end.

The '773 and '140 patents disclose further improvements in barrier devices including side walls formed with higher curb reveals, a horizontally extending step and vertical indentations in order to assist in maintaining the structural integrity of the container, and internal baffles for dampening movement of water or other ballast material within the container interior. Interlocking male and female coupling elements are formed on the opposite end walls of each barrier to facilitate connection of adjacent barriers end-to-end. Additionally, channels or openings are formed in the barriers from one side wall to the other to permit the insertion of the tines of a fork lift truck therein for easy loading, unloading and handling of the barriers.

One problem with barrier devices of the type described above is that the coupling elements which connect one barrier device to an adjacent one permit limited pivotal movement. While a gradual curve along a barrier wall formed by a number of interconnected barrier devices may be obtained, the amount of articulation between adjacent barriers is limited to a few degrees. The formation of corners or other angles along a barrier wall of 90° or more is not possible.

SUMMARY OF THE INVENTION

This invention is directed to a pivot unit for use with barrier devices which may be connected end-to-end to form a barrier wall. The pivot unit comprises first and second end connectors, each of which may be coupled to the end of one barrier device, and a hinge post extending between the end connectors. The hinge post is mounted by a pin to each end connector allowing pivotal motion of one end connector, and the barrier device to which it is coupled, through an angle of at least 90° relative to the other end connector and its associated barrier device.

In one presently preferred embodiment, each of the end connectors is formed with a seat including an upper plate having a bore and a spaced, lower plate with an aligning bore. The hinge post has a head section, a base section and a stem section connected between the head and base sections. A portion of both the head section and base section on either side of the stem section protrudes outwardly from the stem section and is formed with a bore, such that there are two, spaced bores in the head section and two in the base section. One side of the hinge post is received in the seat of one end connector, with the protruding parts of the head and base sections resting against the upper and lower plates of the seat, and the other side of the hinge post is similarly located in the seat of the other end connector. Each side of the hinge post is connected by a pivot pin to the seat of an end connector, with each pin extending through the aligning bores of the seat and one side of the hinge post.

Each end connector is joined to an adjacent barrier device by inserting a coupler into a locking channel collectively formed by a slot in the barrier device and a slot in the abutting end connector. Additionally, one of the end connectors is formed with an extension along the base thereof which is received within a cavity in the base of an abutting barrier device, while the other end connector is formed with a cavity to receive an extension at the base of an abutting barrier device.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
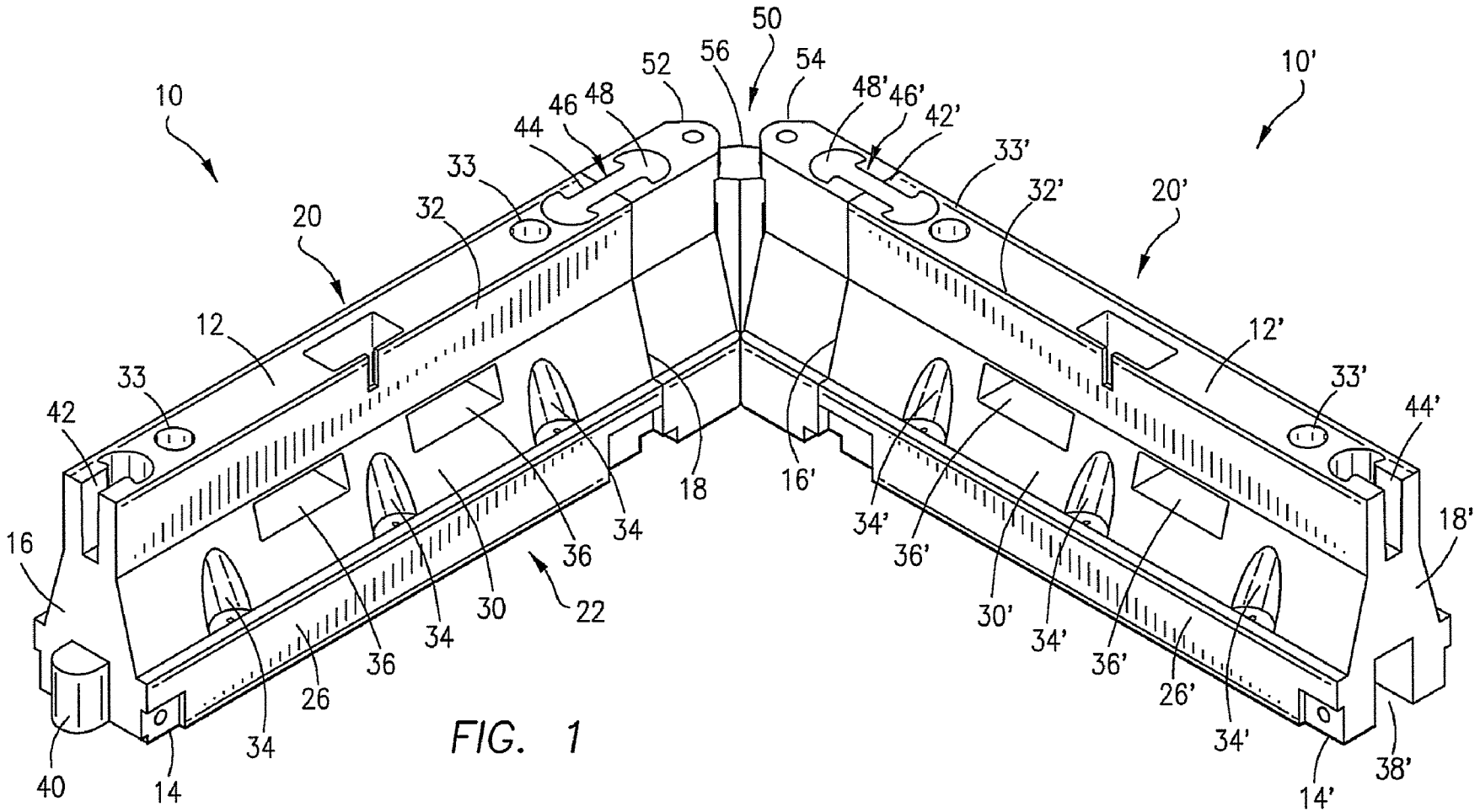
FIG. 1 is a perspective view of two barrier devices connected by the pivot unit of this invention.
Figure 2:
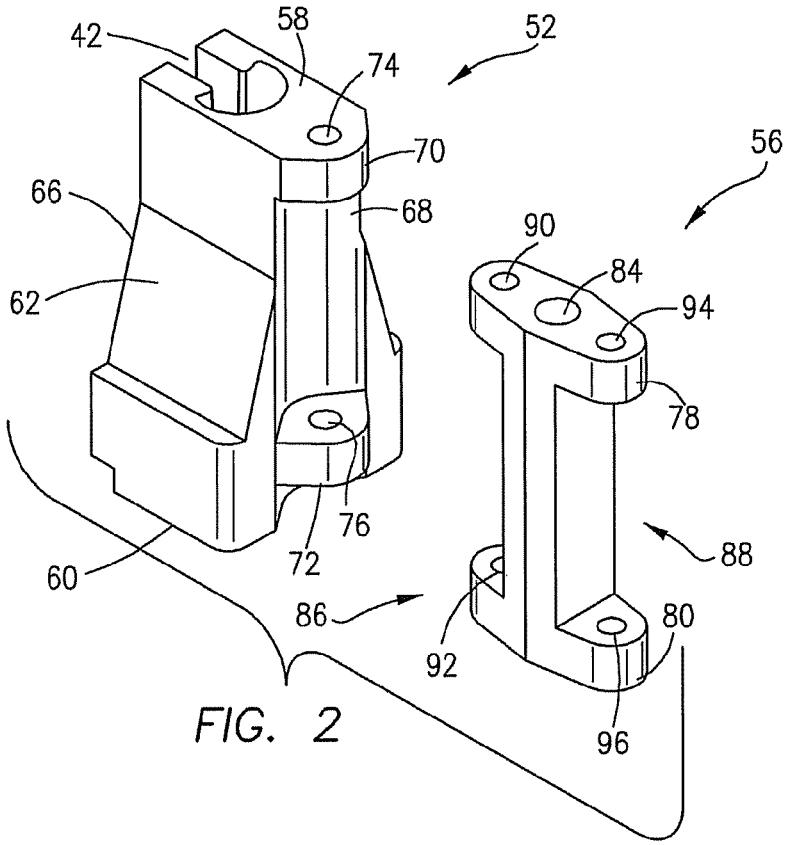
FIG. 2 is a disassembled perspective view of one end connector and the hinge post of the pivot unit herein.

Referring initially to FIG. 1, the barrier device 10 of this invention comprises a top wall 12, a bottom wall 14, opposed end walls 16, 18, and, opposed side walls 20, 22 which are interconnected to collectively define a hollow interior. A number of barrier devices 10 may be arranged end-to-end to form an essentially continuous wall. Two barrier devices 10, 10' are shown in FIG. 1 which are identical in structure and function, and therefore the same reference numbers are used to identify like structures with the addition of a "'" to the numbers associated with the barrier 10' on the right-hand side of FIG. 1.

In the presently preferred embodiment, each of the walls 12-22 are formed of a semi-rigid plastic material chosen from the group consisting of low density polyethylene, acrylonitrile or butadiene styrene, high impact styrene, polycarbonates and the like. These plastic materials are all inherently tough and exhibit good energy absorption characteristics. They will also deform and elongate, but will not fail in a brittle manner at energy inputs which cause other materials to undergo brittle failure. The surfaces of these types of plastic materials are inherently smoother than materials from which other barriers are typically constructed, therefore creating less friction and reducing the likelihood of serious abrasion injuries to vehicles and/or passengers who may come into contact therewith. Additionally, materials of this type are unaffected by weather and have excellent basic resistance to weathering, leaching and biodegradation. Additives such as ultraviolet inhibitors can be combined with such plastic materials, making them further resistant to the effects of weather. They also retain their mechanical and chemical properties at low ambient temperatures.

When using the barrier device 10 of this invention as a highway barrier, the hollow interior is preferably filled with a "ballast" material such as water or other liquid, or a flowable solid material such as sand, concrete and the like. For this purpose, the walls 12-22 of barrier device 10 have a thickness in the range of about one-eight inch to one inch so as to perform satisfactorily in service. The barrier device 10 is preferably in the range of about six to eight feet in length, and, at the wall thickness noted above, has a weight when empty of about 80 to 140 lbs. When filled with a liquid such as water, the overall weight of the barrier is in the range of about 1,400 to 2,200 lbs. Flowable solid material such as sand and the like increase the weight of barrier 10 further.

The side walls 20 and 22 each include a substantially vertically oriented curb reveal 26 located between the bottom wall 14 and a horizontally extending ledge or step 28. Extending upwardly at an acute angle from the step 28 is an intermediate section 30 which terminates at a vertical upper section 32. The upper section 32, in turn, extends from the intermediate section 30 to the top wall 12 of barrier 10 which is formed with a pair of fill holes 33 preferably having a diameter in the range of about 3-4 inches. In the presently preferred embodiment, a number of stabilizers 34 are integrally formed in the intermediate section 30, at regularly spaced intervals between the end walls 16, 18. Openings 36 extend through the barrier device 10, between the side walls 20 and 22, which are sized to receive the tines of a fork lift truck in order to move the barrier device 10 from place to place.

In the formation of a barrier wall, the end wall 16 of one barrier device 10 abuts and is coupled to the end wall 18 of an adjacent barrier device 10. For ease of illustration, only the end wall 16 of barrier device 10 and the end wall 18' of barrier device 10' are shown, it being understood that the end wall 16' of barrier device 10' and the end wall 18 of barrier device 10 (not shown in detail) have the same construction. The structure for coupling two barriers 10 and 10' to one another, and to the pivot unit 50 of this invention described in detail below, is formed on the end walls 16, 18. As seen in FIG. 1, the end wall 18' of barrier device 10' is formed with an internally extending recess 38' near the bottom wall 14', which receives an outwardly protruding extension 40 formed on the end wall 16 of an adjacent barrier 10 or the pivot unit 50 as described below. The upper portion of end wall 16 is formed with a slot 42, and the upper portion of end wall 18' is formed with a slot 44'.

When two barrier devices 10 and 10' are oriented end-to-end, with the end wall 16 of barrier device 10 abutting the end wall 18' of an adjacent barrier 10', the slots 42 and 44' collectively form a barbell-shaped locking channel 46 of the same structure and dimension as that depicted at the juncture of barriers 10, 10' and the pivot unit 50 of this invention, discussed in detail below. This locking channel 46 receives a coupler 48 which is removably insertable therein and extends substantially along the entire length of the locking channel 46. The ends of the coupler 48 pivot within the corresponding locking channel 46, so that one barrier device 10 can be pivoted with respect to an adjacent barrier 10' to assist with alignment thereof, and to allow the barriers devices 10, 10' when placed end-to-end, to follow gradual curves along a particular highway or other location where they are placed.

The connection between the locking channel 46 and couplers 48 described above allows for limited pivoting of one barrier device 10 relative to an adjacent barrier device 10'. In some installations, such as where a number of barrier devices 10 are connected end-to-end to form an elongated barrier wall, it is desirable to provide one or more locations along such wall where adjacent barrier devices 10 can pivot relative to one another through a much greater angle, e.g. 90° or more. The pivot unit 50 of this invention is designed to provide that capability.

The pivot unit 50 includes a first end connector 52 and a second end connector 54 which are pivotally connected to one another by a hinge post 56. Except as noted below, the end connectors 52 and 54 are identical to one another and therefore only the detailed structure of end connector 52 is discussed herein it being understood that the such description applies to the end connector 54. The same reference numbers used to describe end connector 52 are applied to end connector 54 with the addition of a "'" to end connector 54.

The end connector 52 includes a top wall 58, a bottom wall 60, opposed side walls 62, 64 and opposed end walls 66, 68. The end wall 66 of end connector 52 has the same configuration as the end wall 16 of barrier device 10, e.g. it is formed with a slot 42 at the top and an extension 40 at the bottom. The end connector 52 may be joined to the barrier device 10 by abutting its end wall 66 to the end wall 18 of the barrier device 10 so that the slot 42 of end connector 52 and the slot 44 of barrier device 10 collectively form a locking channel 46 which receives coupler 48, as described above. The extension 40 at the bottom of the end connector 52 is received within the recess 38 at the bottom of the barrier device 10. A similar connection is made between the second end connector 54 and the barrier device 10', except that the end wall 68' of end connector 54 is formed with a recess 38' at the bottom instead of an extension 40. The end wall 68' of end connector 54 abuts the end wall 16' of barrier device 10' so that the slot 44' of the end connector 54 and the slot 42' of the barrier device 10' collectively form a locking channel 46' to receive a coupler 48'. The extension (not shown) at the base of the barrier device 10' is inserted within the recess (not shown) at the bottom of the end connector 54.

The end wall 68 of end connector 52 is formed with a seat consisting of an upper plate 70 spaced from a lower plate 72. The upper plate 70 is generally planar with the top wall 58, but the lower plate 72 is spaced upwardly relative to the bottom wall 60. The upper plate 70 is formed with a through bore 74 which aligns with a through bore 76 in the lower plate 72. The end wall 68' of the connector 54 has the same construction as end wall 68 of end connector 52.

The hinge post 56 is formed with a head section 78, a base section 80 and a stem section 82 extending between the head and stem sections 78, 82. A central bore 84 extends through the hinge post 56, from its head section 78 toward the base section 80, where it terminates and forms a post boot 85. A sign, post or the like (not shown) may be inserted into the bore 84 and rest at its lower end within the post boot 85. Portions of both the head section 78 and base section 80 protrude outwardly from the stem section 82 defining a first side 86 and a second side 88 of the hinge post 56. The first side 86 of hinge post 56 has aligning bores 90 and 92 formed in the head section 78 and based section 80, respectively. Similarly, aligning bores 94 and 96 are formed in respective head and stems sections 78, 80 of the second side 88 of hinge post 56.

Figure 3:
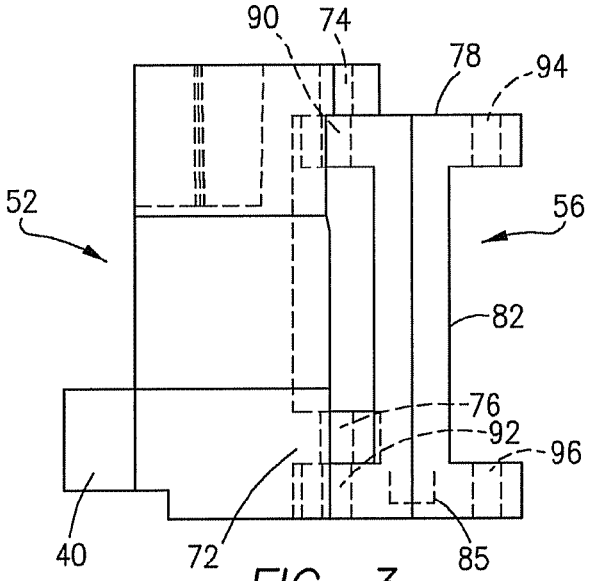
FIG. 3 is a side view of the structure shown in FIG. 2 in the assembled position.
Figure 4:
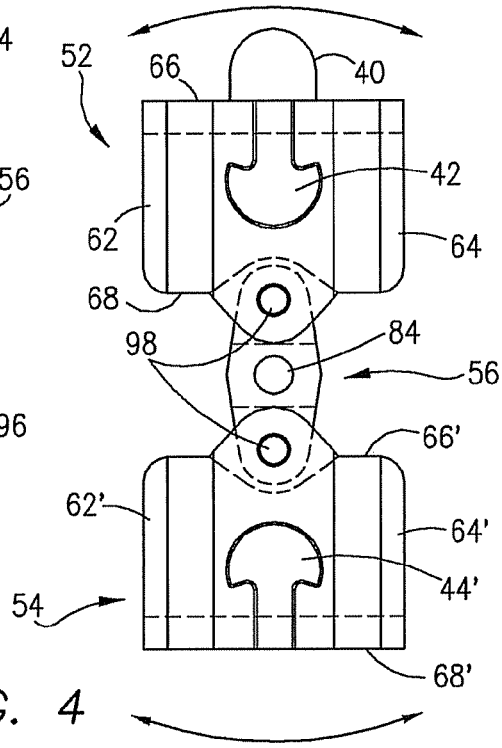
FIG. 4 is a plan view of the pivot unit connected to two barrier devices.

The pivot unit 50 is assembled by sliding the first side 86 of the hinge post 56 into engagement with the seat on the end wall 68 of the end connector 52. As best seen in FIG. 3, the upper plate 70 of the seat overlies the head section 78 of the hinge post 56 and the base section 80 of the hinge post 56 extends beneath the lower plate 72 of the seat such that the bores 74 and 76 in respective plates 70, 72 align with the bores 90 and 92, respectively, in the head and base sections 78 and 80. A pivot pin 98 is inserted through the aligning bores 74 and 90, and through the aligning bores 76 and 92 to connect the hinge post 56 to the end connector 52. See FIG. 4. The same connection described above in connection with the hinge post 56 and end connector 52 is made between the second side 88 of the hinge post 56 and the end wall 68' of the end connector 54.

The pivot unit 50 is secured to the barrier devices 10 and 10' by couplers 48, and the connection between recesses 38 and extension 40 as described in detail above. Unlike barrier walls of the prior art, the pivot unit 50 permits at least 90° of articulation in one direction between the end connectors 52 and 54, which, in turn, allows the associated barrier devices 10 and 10' to pivot relative to one another over the same angle. As seen in FIG. 1, the barrier 10 is disposed at a 90° angle relative to barrier 10' in a clockwise direction as oriented in the drawing. The barrier 10' may be pivoted up to 180° in the opposite, counterclockwise direction relative to barrier 10 so as to be positioned at a 90° angle on the opposite side of barrier 10, as desired.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A pivot unit for connecting adjacent barrier devices, comprising:

a first end connector adapted to be coupled to one end of a first barrier device and a second end connector adapted to be coupled to one end of a second barrier device, each of said first and second end connectors being formed with a seat having at least one bore;

a hinge post having a head section, a base section and a stem section connected between said head section and said base section, at least one of said head section and said base section of said hinge post being formed with a first bore and a spaced second bore, said hinge post being received within said seat of said first end connector so that said first bore of said hinge post aligns with said at least one bore of said seat, said hinge post being received within said seat of said second end connector so that said second bore of said hinge post aligns with said at least one bore of said seat; and a first hinge pin insertable into said aligning bores of said hinge post and said seat of said first end connector, and a second hinge pin insertable into said aligning bores of said hinge post and said seat of said second end connector.

2. The pivot unit of claim 1 in which said seat of said first end connector includes an upper plate formed with a first upper bore and a spaced, lower plate formed with a first lower bore which aligns with said first upper bore said seat of said second end connector including an upper plate formed with a second upper bore and a spaced, lower plate formed with a second lower bore which aligns with said second upper bore.

3. The pivot unit of claim 2 in which a portion of each of said head section and said base section of said hinge post protrudes outwardly from said stem section, each of said protruding portions of said head section and said base section being formed with one of said first and second bores, said first and second bores of said head section aligning with said first and second bores of said base section.

4. The pivot unit of claim 3 in which said protruding portions of said head section and said base section of said hinge post are positioned adjacent one of said upper and lower plates forming said seat of said first end connector so that said first bore of said head section aligns with said first upper bore in said upper plate of said first end connector and said first bore of said base section aligns with said first lower bore in said lower plate of said first end connector.

5. The pivot unit of claim 4 in which said protruding portions of said head section and said base section of said hinge post are positioned adjacent one of said upper and lower plates forming said seat of said second end connector so that said second bore of said head section aligns with said second upper bore in said upper plate of said second end connector and said second bore of said base section aligns with said second lower bore in said lower plate of said second end connector.

6. The pivot unit of claim 1 in which said hinge post and said first and second end connectors permit at least 90° of articulation of one barrier device relative to an adjacent barrier device.

7. The pivot unit of claim 1 in which said hinge post is formed within a central bore which terminates within a post boot, said central bore being adapted to receive a post, sign or the like.

8. An articulating barrier wall, comprising:

a number of barrier devices coupled end-to-end, at least one first barrier device and at least one second barrier device each being formed with a slot;

a pivot unit connected between said at least one first barrier device and said at least one second barrier device, said pivot unit comprising:

(i) a first end connector and a second end connector each formed with a seat having at least one bore, each of said first and second end connectors being formed with a slot;

(ii) a hinge post having a head section, a base section and a stem section connected between said head section and said base section, at least one of said head section and said base section of said hinge post being formed with a first bore and a spaced second bore, said hinge post being received within said seat of said first end connector so that said first bore of said hinge post aligns with said at least one bore of said seat, said hinge post being received within said seat of said second end connector so that said second bore of said hinge post aligns with said at least one bore of said seat;

(iii) a first hinge pin insertable into said aligning bores of said hinge post and said seat of said first end connector, and a second hinge pin insertable into said aligning bores of said hinge post and said seat of said second end connector;

said first end connector abutting said at least one first barrier device so that said slot of said first end connector aligns with said slot in said first barrier device to form a locking channel, and said second end connector abutting said at least one second barrier device so that said slot of said second end connector aligns with said slot in said second barrier device to form a locking channel;

a first coupler insertable within said locking channel formed by said first end connector and said at least one first barrier device, and a second coupler insertable within said locking channel formed by said second end connector and said at least one second barrier device.

9. The articulating baffler wall of claim 8 in which one of said at least one first and second barrier devices is formed with an extension, and the other of said at least one first and second barrier devices is formed with a recess.

10. The articulating barrier wall of claim 9 in which one of said first and second end connectors is formed with an extension and the other of said first and second end connectors is formed with a recess, said extension of one of said first and second end connectors being insertable within said cavity of one of said at least one first and second barrier devices and said extension of said at least one first and second barrier devices being insertable within said cavity of said other of said first and second end connectors.

11. The articulating barrier wall of claim 8 in which said seat of said first end connector includes an upper plate formed with a first upper bore and a spaced, lower plate formed with a first lower bore which aligns with said first upper bore, said seat of said second end connector including an upper plate formed with a second upper bore and a spaced, lower plate formed with a second lower bore which aligns with said second upper bore.

12. The articulating barrier wall of claim 11 in which a portion of each of said head section and said base section of said hinge post protrudes outwardly from said stem section, each of said protruding portions of said head section and said base section being formed with one of said first and second bores, said first and second bores of said head section aligning with said first and second bores of said base section.

13. The articulating barrier wall of claim 12 in which said protruding portions of said head section and said base section of said hinge post are positioned adjacent one of said upper and lower plates forming said seat of said first end connector so that said first bore of said head section aligns with said first upper bore in said upper plate of said first end connector and said first bore of said base section aligns with said first lower bore in said lower plate of said first end connector.

14. The articulating barrier wall of claim 13 in which said protruding portions of said head section and said base section of said hinge post are positioned adjacent one of said upper and lower plates forming said seat of said second end connector so that said second bore of said head section aligns with said second upper bore in said upper plate of said second end connector and said second bore of said base section aligns with said second lower bore in said lower plate of said second end connector.

15. The articulating barrier wall of claim 8 in which said hinge post and said first and second end connectors permits at least 90° of articulation of said at least one first barrier device relative to said at least one second barrier device.

16. The articulating barrier wall of claim 8 in which said hinge post is formed within a central bore which terminates within a post boot, said central bore being adapted to receive a post, sign or the like.

* * * * *